US006773305B2

(12) United States Patent
Wu

(10) Patent No.: US 6,773,305 B2
(45) Date of Patent: Aug. 10, 2004

(54) CABLE ASSEMBLY WITH PULL TAB

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/394,940

(22) Filed: Mar. 21, 2003

(65) Prior Publication Data

US 2004/0110411 A1 Jun. 10, 2004

Related U.S. Application Data

(63) Continuation-in-part of application No. 10/316,547, filed on Dec. 10, 2002, now Pat. No. 6,699,072.

(51) Int. Cl.[7] ..... H01R 13/648
(52) U.S. Cl. ..... 439/608; 439/483; 439/76.1
(58) Field of Search ..... 439/608, 483, 439/484, 76.1, 492, 67

(56) References Cited

U.S. PATENT DOCUMENTS 4,583,803 A * 4/1986 Bringuel ..... 439/160
6,461,202 B2 * 10/2002 Kline ..... 439/701
6,520,803 B1 * 2/2003 Dunn ..... 439/608
6,607,402 B2 * 8/2003 Cohen et al. ..... 439/608
6,638,110 B1 * 10/2003 Billman ..... 439/608
6,641,438 B1 * 11/2003 Billman ..... 439/608
6,663,427 B1 * 12/2003 Billman et al. ..... 439/608
6,663,429 B1 * 12/2003 Korsunsky et al. ..... 439/608
6,685,510 B1 * 2/2004 Wu ..... 439/608
6,692,305 B2 * 2/2004 Nelson et al. ..... 439/608
6,699,072 B1 * 3/2004 Wu ..... 439/608
6,699,073 B1 * 3/2004 Wu ..... 439/608

* cited by examiner

*Primary Examiner*—Gary F. Paumen
(74) *Attorney, Agent, or Firm*—Wei Te Chung

(57) ABSTRACT

A cable assembly (1) includes a front housing portion (10) receiving a number of juxtaposed printed circuit boards (22) each extending along a first direction of the housing and a number of cables (23) extending from each of the circuit boards. A rear housing portion (30) is attached to the front housing portion and includes a first half (31) and a second half (32) joined together. A pull tab (40) includes a pair of spaced arms (404) connected to the rear housing portion and a handle (402) connecting the spaced arms for being exerted on by an external force to release the cable assembly from a mating connector.

2 Claims, 13 Drawing Sheets

CABLE ASSEMBLY WITH PULL TAB

CROSS-REFERENCE TO RELATED APPLICATIONS

This patent application is a continuation-in-part (CIP) of U.S. patent application Ser. No. 10/316,547 filed on Dec. 10, 2002, now U.S. Pat. No. 6,699,072 and entitled "CABLE ASSEMBLY".

Relevant subject matter is also disclosed in pending U.S. patent application Ser. No. 10/278,520 filed on Oct. 22, 2002 and entitled "ELECTRICAL CABLE CONNECTOR" and U.S. patent application Ser. No. 10/317,830 filed on Dec. 11, 2002 and entitled "CABLE ASSEMBLY", all of which are invented by the same inventor as this patent application and assigned to the same assignee with this application.

BACKGROUND OF THE INVENTION

1. Field of the Invention

The present invention relates to a cable assembly for high speed signal transmission, and particularly to a cable assembly having a pull tab for facilitating disengaging the cable assembly from a mating connector.

2. Description of Related Art

With the development of communication and computer technology, high density electrical connectors are desired to construct a large number of signal transmitting paths between two electronic devices. Each of these electrical connectors provides a plurality of circuit boards to thereby achieve improved signal transmission of different electrical characteristics through the connector. Such high density electrical connectors, such as cable assemblies, are widely used in internal connecting systems of severs, routers and the like requiring high speed data processing and communication.

U.S. Pat. No. 6,217,364, issued to Miskin et al., discloses a cable assembly including an insulating housing formed by a pair of substantially identical housing halves and an electrical cable with a plurality of wires terminated to conductive terminals overmolded in a plurality of thin flat wafers. The housing halves combines to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However, the cable and wafer subassembly are retained in the housing by securing the housing halves together through bolts and nuts, thereby complicating the assembly of the cable assembly. Furthermore, an engagement of the housing halves is easy to become loose due to vibration during the transportation and other matters, whereby the cable and the wafer subassembly cannot be stably retained in the housing.

U.S. Pat. Nos. 5,924,899 (the '899 patent) and 6,102,747, both issued to Paagman, each disclose a cable assembly. Referring to FIGS. 4*a*–4*c* and 5*a*–5*c* of the '899 patent, the cable assembly includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite the terminal carrier. The insulation displacement carrier has insulation displacement contacts connecting with conductors of corresponding cables. The modules are retained in the housing through an interference fit with the housing.

When the cable assembly disclosed in the above-mentioned patents is required to disengage from a mating connector, a pulling force is exerted on an exposed end of the cable to release the engagement between the cable assembly and the mating connector. The modules/flat wafers may be pulled back with regard to the housing. Furthermore, a connection between the cable and the module/flat wafer may become loosen and the cable may even break off from the module/flat wafer. As a result, when the cable assembly mates with the mating connector again, an electrical connection therebetween is adversely affected.

Hence, an improved cable assembly is required to overcome the disadvantages of the related art.

SUMMARY OF THE INVENTION

Accordingly, a first object of the present invention is to provide a cable assembly facilitating a disengagement thereof from a mating complementary connector.

A second object of the present invention is to provide a cable assembly having a plurality of individual circuit boards reliably retained in an insulating housing thereof.

In order to achieve the objects set forth, a cable assembly in accordance with the present invention comprises a front housing portion receiving a plurality of juxtaposed printed circuit boards each extending along a first direction and a plurality of cables side by side extending rearwardly from a rear edge of each of the circuit boards. A rear housing portion is attached to the front housing portion and comprises a first half and a second half joined together. A pull tab comprises a pair of spaced arms connected to the rear housing portion and a handle connecting with the spaced arms for being exerted on by an external force to release the cable assembly from a mating connector.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
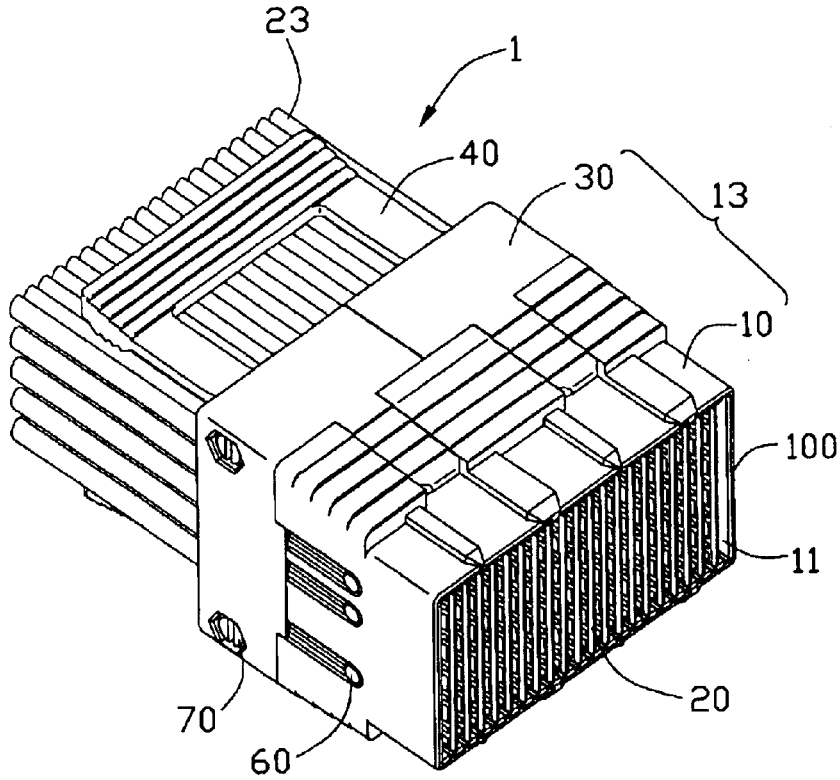
FIG. 1 is an assembled perspective view of a cable assembly in accordance with the present invention.
Figure 3:
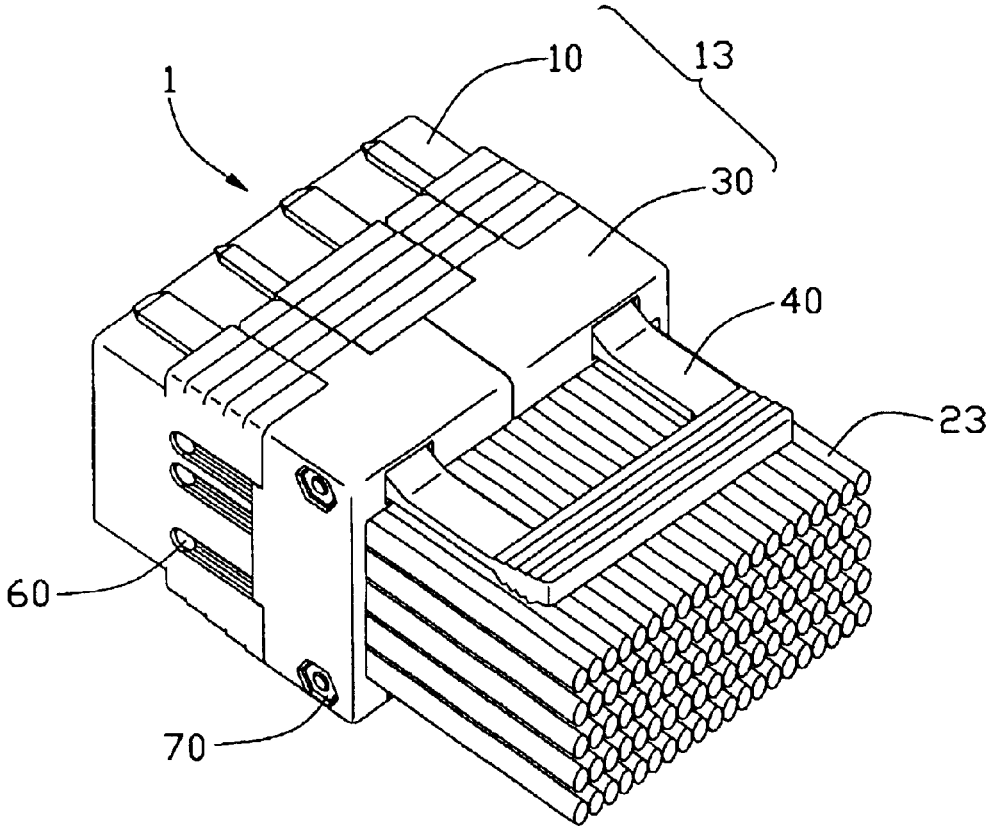
FIG. 3 is a view similar to FIG. 1 but taken from a different perspective.

Referring to FIGS. 1 and 3, a cable assembly 1 in accordance with the present invention comprises an insulating housing 13, a plurality of circuit modules 20 received in the insulating housing 13 and a pair of pull tabs 40 extending rearwardly from the insulating housing 13 for facilitating releasing the cable assembly 1 from a mating connector (not shown).

Figure 2:
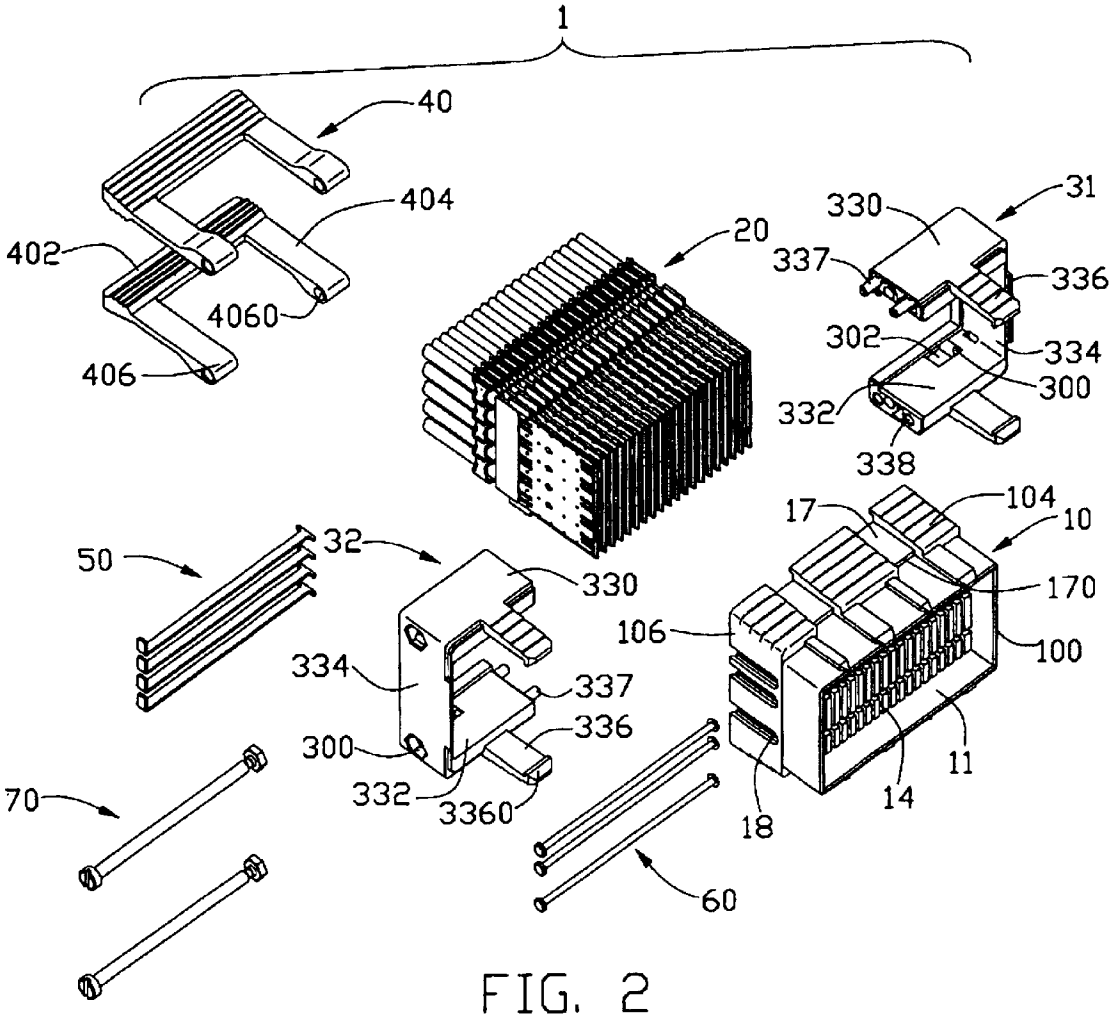
FIG. 2 is an exploded perspective view of the cable assembly shown in FIG. 1.
Figure 4:
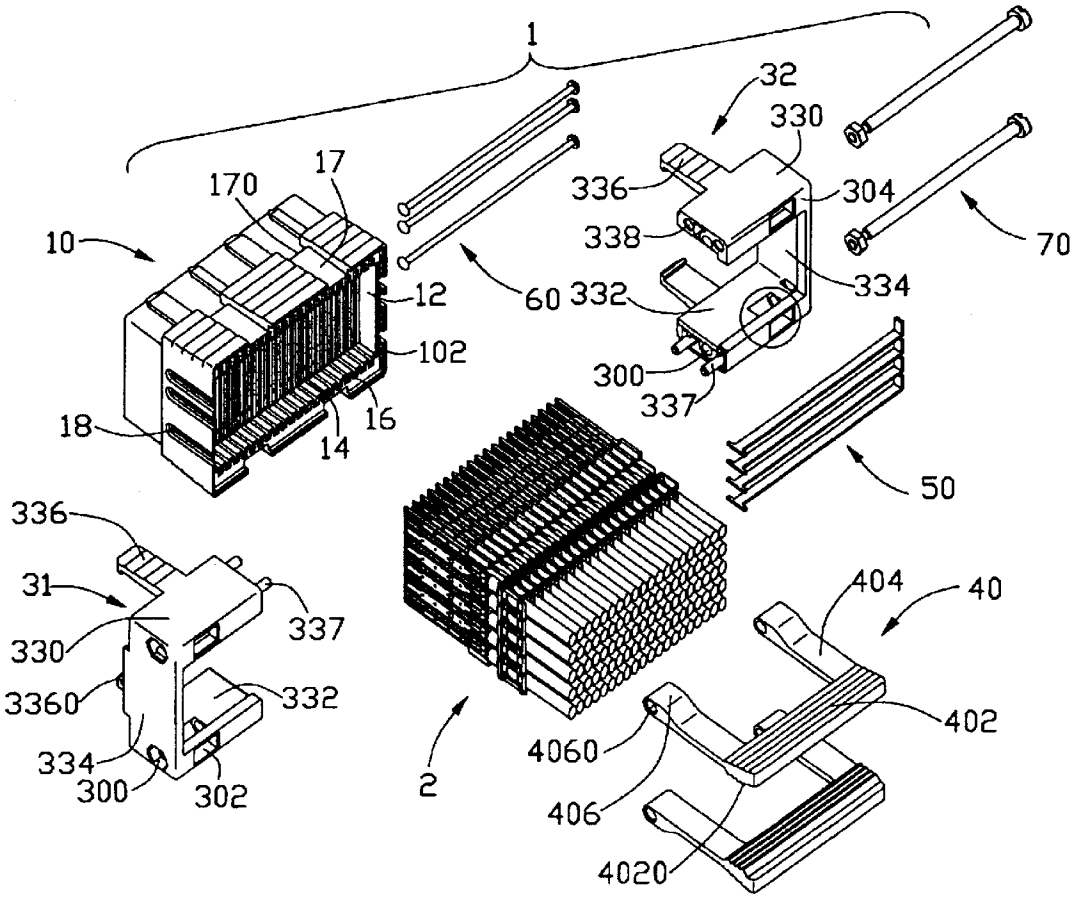
FIG. 4 is an exploded perspective view of the cable assembly shown in FIG. 3.

Referring to FIGS. 2 and 4, in the preferred embodiment of the present invention, the insulating housing 13 comprises a front housing portion 10 and a two-piece rear housing portion 30 together with the front housing portion 10 for retaining the circuit modules 20.

The front housing portion 10 is generally in a rectangular shape. The front housing portion 10 has a front mating port 11 in a front mating face 100 which faces the mating connector and a rear chamber 12 in a rear face 102. The front housing portion 10 defines a plurality of parallel channels 14 extending in a front-to-back direction communicating with the front mating port 11 and the rear chamber 12 and a plurality of grooves 16 which are aligned with the channels 14. The front housing portion 10 further defines a plurality of recesses 17 respectively in a top face 104 and a bottom face (not labeled) and a plurality of cavities 170 recessed downwardly from the corresponding recesses 17. An aperture 18 is defined through opposite side faces 106 of the front housing portion 10 in a lateral direction substantially perpendicular to the extending direction of the channels 14.

Each one of the circuit modules 20 is identical in structure and an exemplary one thereof being shown in FIGS. 5–8. Each circuit module 20 comprises a circuit board 22 received in the channels 14 of the front housing portion 10 and a plurality of cables 23 electrically connecting with the circuit board 22. The circuit board 22 includes a dielectric substrate made of conventional circuit board substrate material, such as FR4, a plurality of conductive signal traces (not labeled) on one side of the substrate for providing electrical paths through the cable assembly 1 and a plurality of grounding traces (not labeled) on both sides of the substrate for grounding purpose. The circuit board 22 defines a through hole 222 aligned with the aperture 18 of the front housing portion 10. The cables 23 of each circuit module 20 are arranged in a common plane and have conductive cores 230 soldered to the signal traces on a rear edge 220 of the circuit board 22.

The circuit module 20 further comprises a grounding plate 24 and a clamp 25 adapted for being applied to the cables 23. The grounding plate 24 is preferably a copper tape and is located above the conductive cores 230 that are soldered onto the circuit board 22 to provide EMI shielding function to the conductive cores 230.

In the preferred embodiment of the present invention, the clamp 25 includes a first tape 251 and a second tape 252 both are stamped and formed from metal tapes. The first tape 251 defines a plurality of rooms 253 and forms a plurality of bridges 254 between adjacent rooms 253. Each bridge 254 defines a pair of openings 255 at opposite ends thereof. The second tape 252 includes a body portion 256 and two rows of tails 257 upwardly extending from two opposite sides of the body portion 256. The first and second tapes 251, 252 clamp the cables 23 from opposite sides with the tails 257 of the second tape 252 being locked in corresponding openings 255 of the first tape 251. The cables 23 are partially depressed by the body portion 256 of the second tape 252 such that they are partially into corresponding rooms 253 of the first tape 251. The first and second tapes 251, 252 further define a number of through holes 266 which are aligned with corresponding gaps 27 between adjacent cables 23.

Figure 4A:
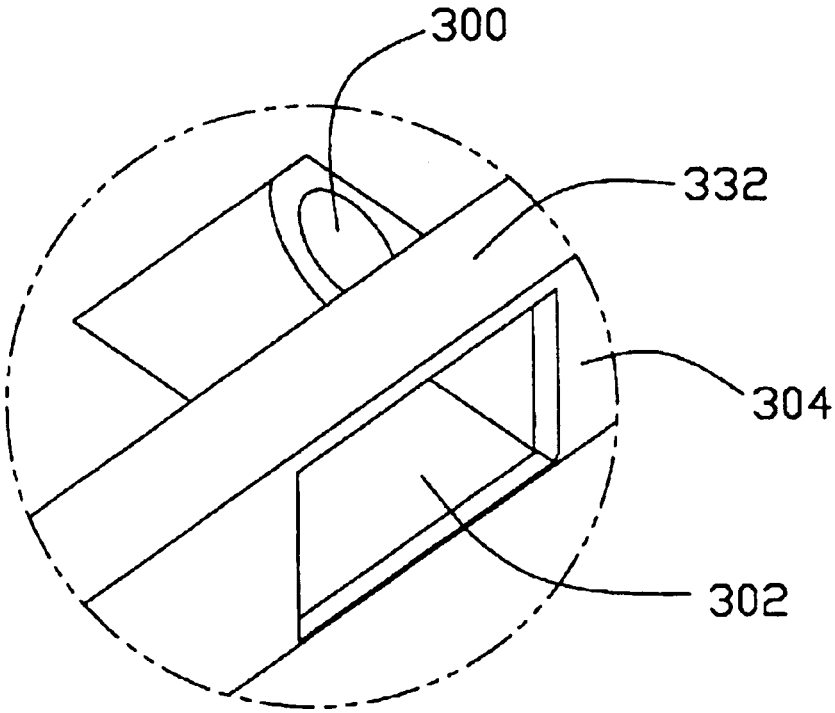
FIG. 4A is an enlarged perspective view taken from a circle of FIG. 4.
Figure 5:
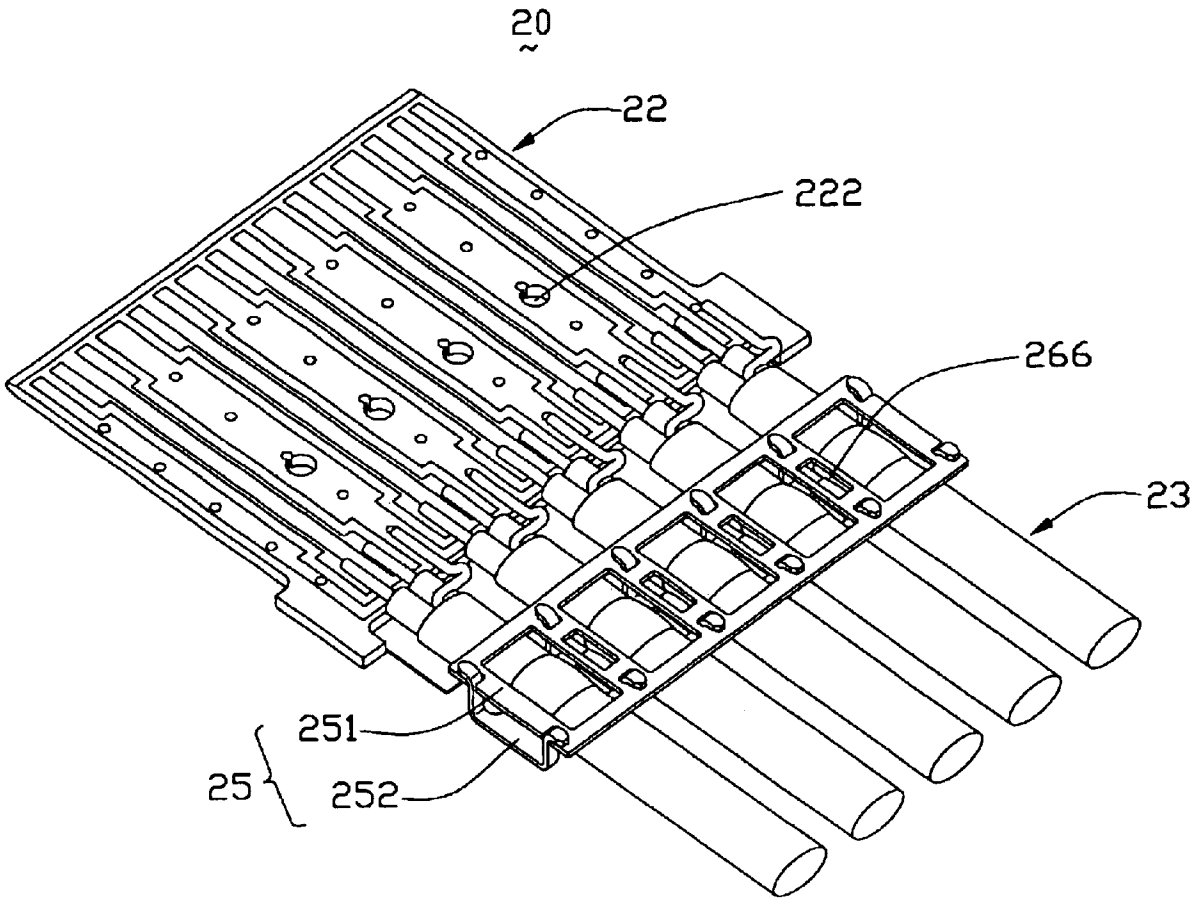
FIG. 5 is an enlarged perspective view of a circuit module of the cable assembly shown in FIG. 2.
Figure 6:
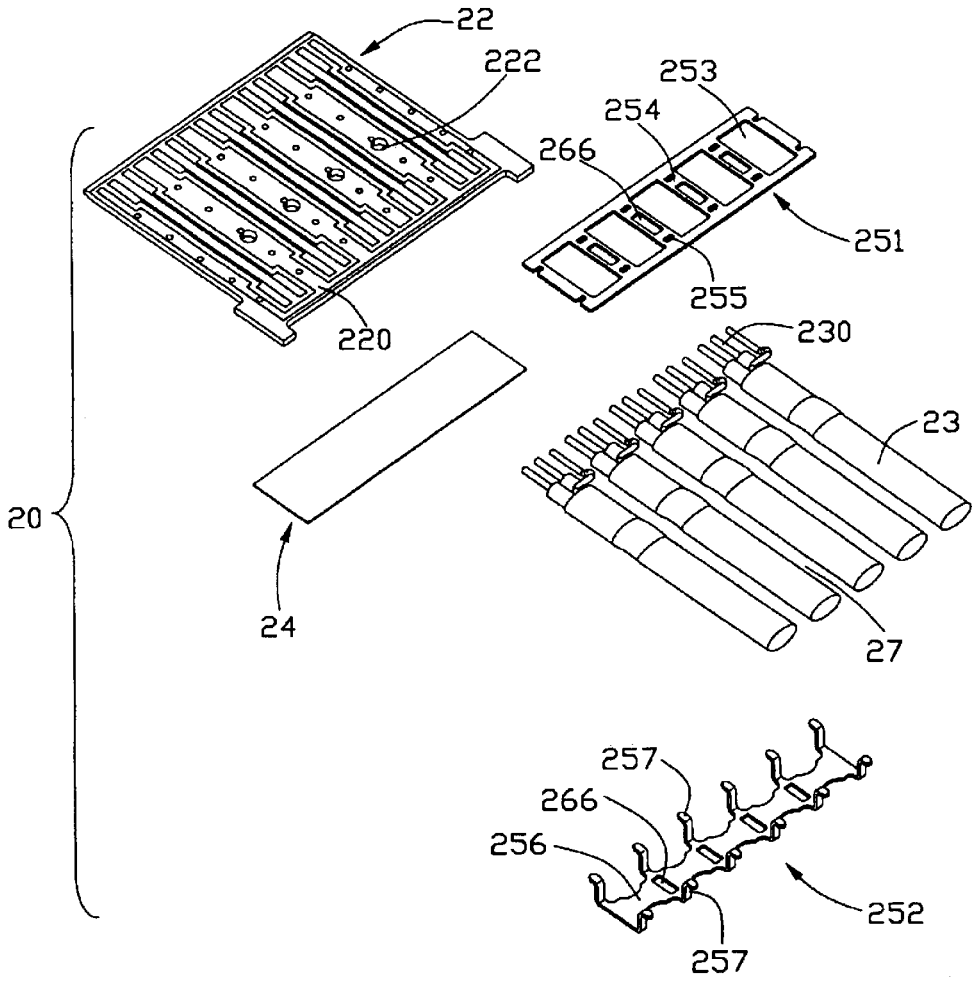
FIG. 6 is an exploded perspective view of the circuit module of FIG. 5.
Figure 7:
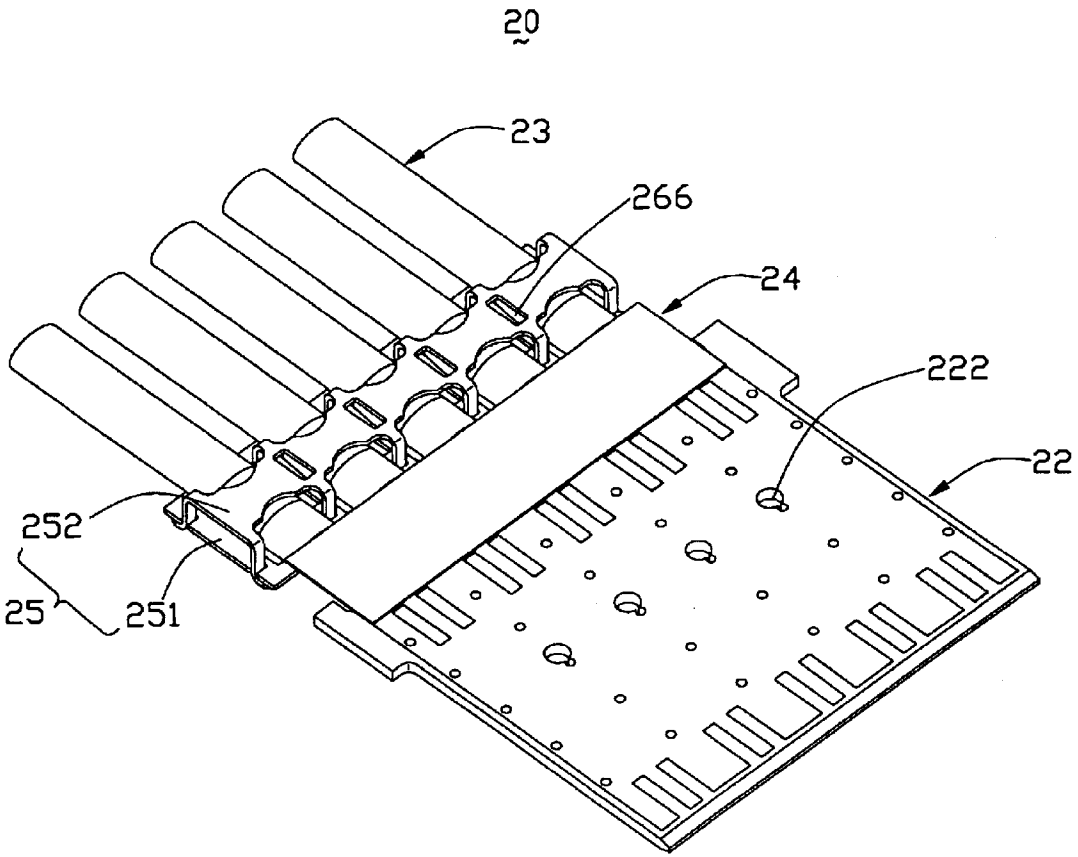
FIG. 7 is a view similar to FIG. 5 but taken from a different perspective.
Figure 8:
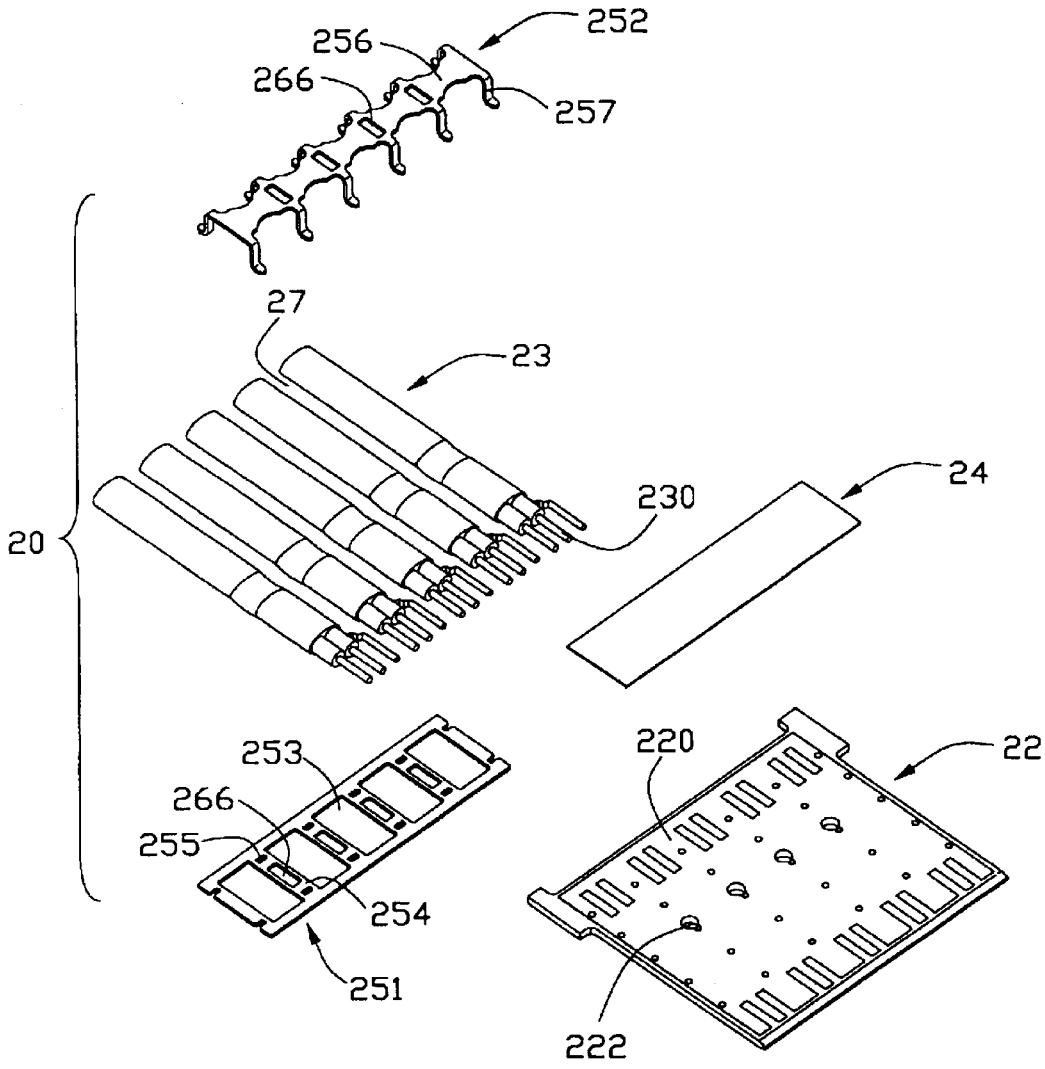
FIG. 8 is a view similar to FIG. 6 but taken from a different perspective.
Figure 9:
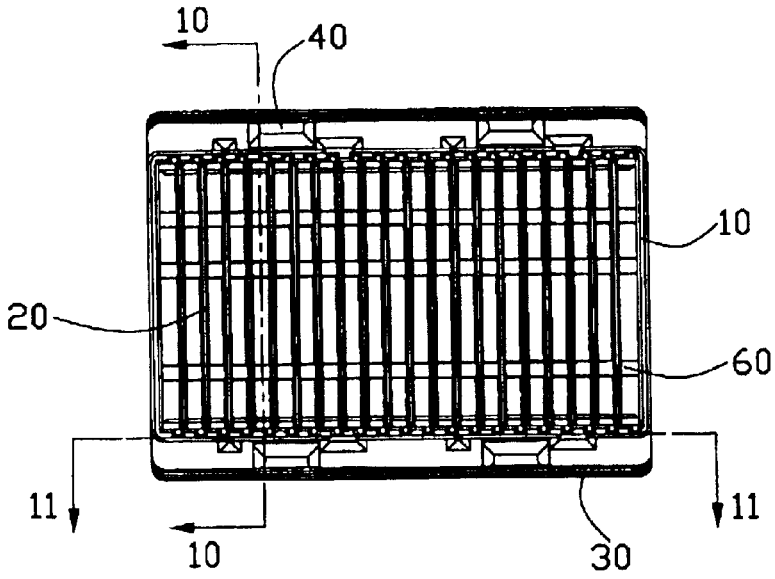
FIG. 9 is a front planar view of the cable assembly shown in FIG. 1.
Figure 10:
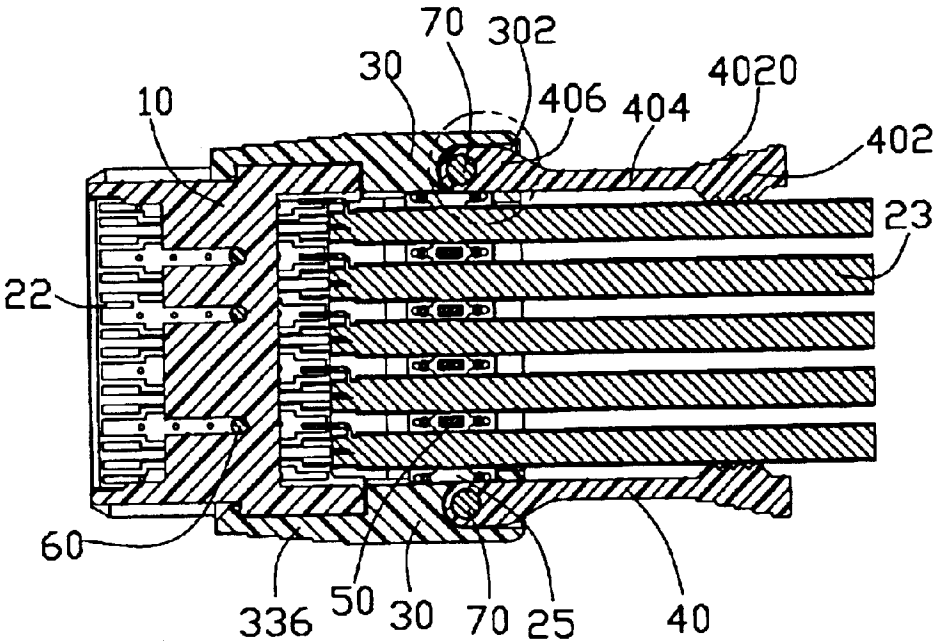
FIG. 10 is a cross-sectional view of the cable assembly taken along line 10—10 in FIG. 9.
Figure 10A:
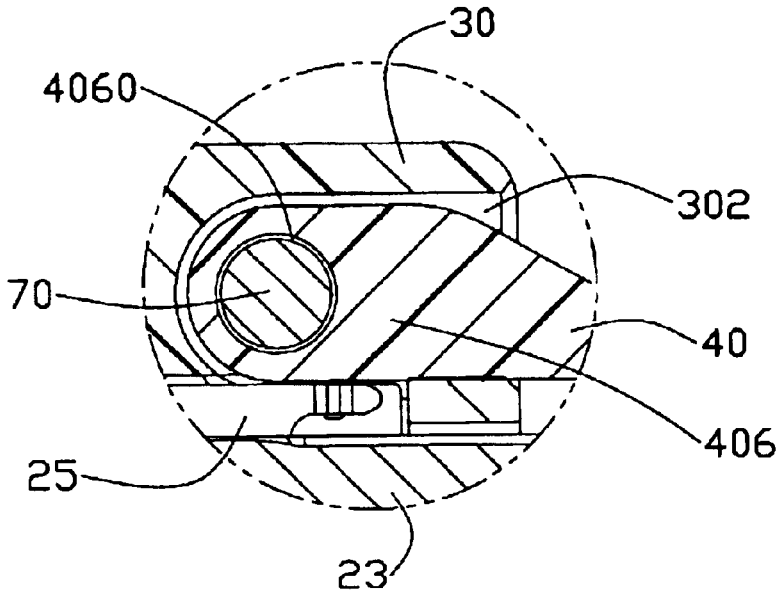
FIG. 10A is an enlarged perspective view taken from a circle of FIG. 10.
Figure 11A:
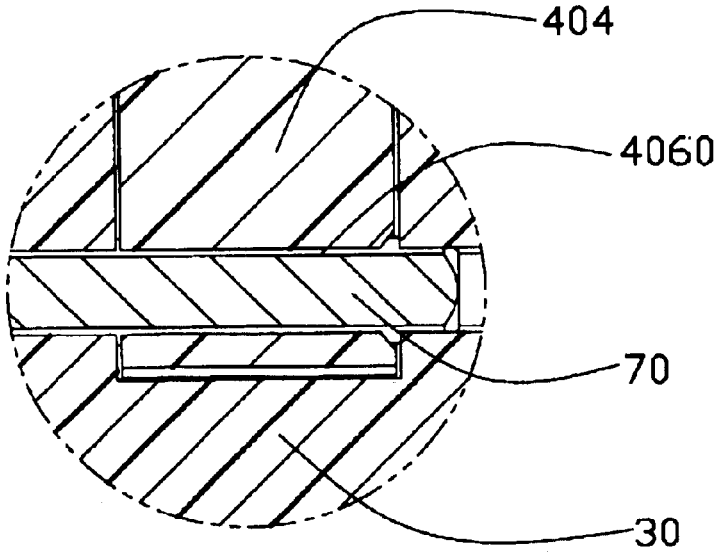
FIG. 11A is an enlarged perspective view taken from a circle of FIG. 11.
Figure 11:
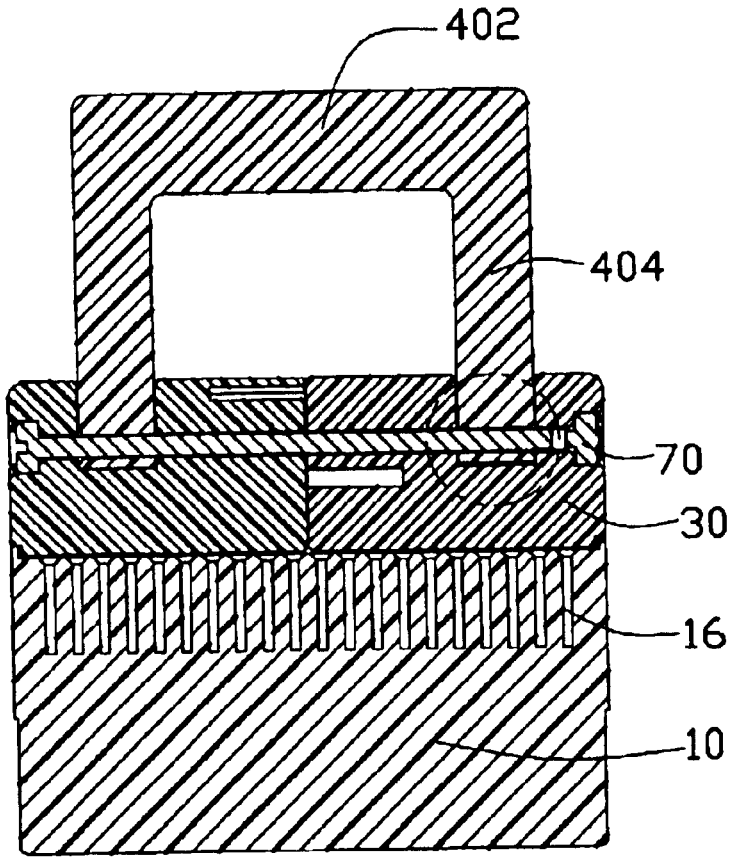
FIG. 11 is a cross-sectional view of the cable assembly taken along section line 11—11 in FIG. 9.

Referring back to FIGS. 2 and 4, the rear housing portion 30 comprises a split body having a first half 31 and a second half 32. Each half 31, 32 has a top panel 330, a bottom panel 332 and a side panel 334 formed between the top panel 330 and the bottom panel 332. Each half 31, 32 forms a pair of latches 336 extending forwardly from front edges of the top and bottom panels 330, 332, a plurality of dowel pins 337 and corresponding holes 338 for joining the first half 31 and the second half 32 together. Each latch 336 has a projection 3360 formed at a free end thereof. The first and second halves 31, 32 define a pair of bores 300 in the top and bottom panels 330, 332 through the side panels 334 and two pairs of cavities 302 in rear surfaces 304 of the top and bottom panels 330, 332 communicating with corresponding bores 300, as best shown in FIG. 4A. It should be noted that any other suitable connecting means may be employed to connect the first and second halves 31, 32. This split design helps to facilitate assembly and installation of the rear housing portion 30 onto the front housing portion 10 over the circuit modules 20.

The pair of pull tabs 40 is identical in structure and each includes a handle 402 for being exerted on by an external force and a pair of spaced arms 404 extending forwardly from opposite ends of the handle 402. Each arm 404 has a connecting portion 406 at a free end thereof with a through hole 4060 defined therein for being received in the corresponding cavity 302 of the rear housing portion 30. The handle 402 forms a plurality of serrations 4020 on opposite surfaces thereof for facilitating grasp by a user's fingers.

Referring to FIGS. 9–11A in conjunction with FIGS. 1 and 2, in assembly, the circuit modules 20 are inserted into the channels 14 of the front housing portion 10 from the rear face 102 until the circuit boards 22 arrives at a position in which front ends of the circuit boards 22 are substantially adjacent to the front mating face 100 of the front housing portion 10. The circuit boards 22 are received in the channels 14 with top and bottom ends retained in the grooves 16. A first fastening element 50 is inserted through the through holes 266 of the first and the second tapes 251, 252 for locking the circuit modules 20 together for strain relief purpose. A second fastening element 60 is inserted through the aperture 18 of the front housing portion 10 and the through holes 222 of the circuit boards 22. The second fastening element 60 is further fastened to the front housing portion 10 for keeping the circuit modules 20 in their original position rather than be pushed back when the cable assembly 1 mates with the mating connector, thereby stably retaining the circuit modules 20 in the front housing portion 10.

The first and second halves 31, 32 of the rear housing portion 30 are first assembled toward each other in the lateral direction by an interference engagement between the dowel pins 337 and the corresponding recesses 338, and then are successively commonly attached to the front housing portion

10 in the front-to-back direction with the projections 3360 of the latches 336 mechanically engaging the cavities 170 of the recesses 17. The rear housing portion 30 is disposed around the clamp 25 of the circuit modules 20.

The pair of pull tabs 40 is attached to the rear housing portion 30 from the rear surface 304 thereof with the connecting portions 406 received in the cavities 302 in which the through holes 4060 are aligned with corresponding bores 300 of the rear housing portion 30. A third fastening element 70 is inserted through the bore 300 of the rear housing portion 30 for preventing the circuit modules 20 from moving in the front-to-back direction. At the same time, the third fastening element 70 extends through the through holes 4060 of the pull tab 40 to thereby securely mounting the pull tab 40 on the rear housing portion 30.

When the cable assembly 1 is required to disengage from the mating connector, an external pulling force is exerted on the handle 402 of the pull tab 40 to release the cable assembly 1 from the mating connector. The circuit modules 20 are stably retained in the front housing portion 10 since the pulling force is exerted on the handle 402 of the pull tab 40 while is not exerted on the cable 23 as conventional practice.

It is noted that since the circuit modules 20 are stably retained between the front housing portion 10 and the rear housing portion 30 via the second and third fastening elements 60, 70, a reliable electrical engagement is ensured between the cable assembly 1 and the mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

an insulating housing;

a plurality of printed circuit boards received in the insulating housing;

a plurality of cables electrically connecting with the printed circuit boards; and a pull tab attached to the insulating housing for facilitating releasing the insulating housing from a mating connector;

wherein the pull tab comprises a pair of spaced arms connected to the insulating housing and a handle connecting the spaced arms for being exerted on by an external pulling force;

wherein the insulating housing comprises a front housing portion and a rear housing portion connected to the front housing portion;

wherein the rear housing portion comprises first and second halves joined together;

wherein the front housing portion defines a plurality of juxtaposed channels extending in a first direction, and the printed circuit boards are side by side received in the channels along a second direction perpendicular to the first direction;

wherein the pull tab comprises a pair of spaced arms connected to the rear housing portion and a handle connecting the spaced arms for being exerted on by an external pulling force;

wherein the rear housing portion defines a pair of cavities, and the arm of the pull tab has a connecting portion received in a corresponding cavity;

wherein the rear housing portion defines a bore extending through the cavities, and the connecting portion of the pull tab defines a through hole aligned with the bore;

wherein the cable assembly comprises a fastening element inserted through the bore of the rear housing portion and the through holes of the connecting portions of the pull tab.

2. A cable connector assembly comprising:

an insulative housing;

at least one printed circuit board fully received in the housing;

a plurality of cables juxtaposed and fixed to a rear region of said at least one printed circuit board, and exposed to an exterior; and at least one pull tab located around a rear portion of the housing and extending rearwardly to not only protectively shield front portions of the cables but also somewhat be deflectable to allow the user to grip thereon for handling the whole connector assembly without imposing undesired forces upon the front portions of the cable bidden under the pull tab;

wherein said pull tab extends generally perpendicularly to said printed circuit board;

wherein a plurality of printed circuit boards are disposed in the housing mutually in a parallel relation;

wherein a rear half of said housing includes two parts assembled by a bolt;

wherein said cables are arranged in a matrix, and there are two pull tabs located on two opposite outmost sides of the housing to sandwich said cables;

wherein said two pull tabs extend perpendicularly to each of said printed circuit boards;

wherein said bolt extends perpendicularly to each of said printed circuit boards;

wherein said bolt retains the pull tab to the housing.

* * * * *